United States Patent [19]

Nunnery et al.

[11] Patent Number: 4,834,154

[45] Date of Patent: May 30, 1989

[54] FIREWOOD PROCESSOR

[75] Inventors: Ermal R. Nunnery; Elmer C. Lusk, both of Columbus, Ohio

[73] Assignee: The Nunnery Wood Processor Co., Columbus, Ohio

[21] Appl. No.: 238,599

[22] Filed: Aug. 31, 1988

[51] Int. Cl.[4] ..... B27L 7/00

[52] U.S. Cl. ..... 144/3 K; 144/193 A; 144/366

[58] Field of Search ..... 144/3 K, 193 A, 192, 144/366

[56] References Cited

U.S. PATENT DOCUMENTS

| | | | |
|---|---|---|---|
| 1,598,695 | 9/1926 | Anderson . | |
| 3,548,895 | 12/1970 | Gentry . | |
| 4,173,237 | 11/1979 | Heikkinen et al. . | |
| 4,269,242 | 5/1981 | Smith et al. . | |
| 4,286,638 | 9/1981 | Connolly et al. | 144/3 K |
| 4,353,401 | 10/1982 | Schilling . | |
| 4,478,263 | 10/1984 | Johnston | 144/3 K |

FOREIGN PATENT DOCUMENTS

| | | | |
|---|---|---|---|
| 1028933 | 4/1978 | Canada | 144/3 K |
| 144977 | 4/1960 | U.S.S.R. | 144/3 K |
| 517495 | 6/1975 | U.S.S.R. | 144/193 A |
| 599971 | 3/1978 | U.S.S.R. | 144/193 A |

OTHER PUBLICATIONS

Data sheet-Bloomfield Firewood Harvester, Models 230 & 330, Bloomfield Farms, California.
Brochure-Woodpecker 441, Syma-Mystemmaskiner AB, Sweden.
Brochure-Screening Systems, Windbergs, Sweden.
Brochure-WFK-Chip Slicer, Windbergs, Sweden.
Brochure-WGS Disc Screen, Windbergs, Sweden.
Brochure-WSF Sound Scrap Trap, Windbergs, Sweden.
Brochure-WSF Chip Thickness Screening, Windbergs, Sweden.
Brochure-The W Shredder, Windbergs, Sweden.
Data sheet-Hodges Hydraulic Wood Splitter.
Letter & data sheet-LaFonte Firewood Processor-s-LaFonte SM-80, LaFonte Corporation, Wisconsin, 1/11/83.
Brochure-Bunyan Automatic Firewood Cutter, Bunyan Wood Cutting Co., Oregon.
Brochure-Beaver Woodeater Firewood Processing Systems, Eaglewood Industries Ltd., Canada.
Brochure-Lickity Log Splitter, Piqua Engineering, Inc., Ohio.
Data sheet-C.T.R. Woodmaster Model 3600-ST-L-FWP, C.T.R. Manufacturing Inc., North Carolina.
Data sheet-Moelven Log Cleaver, Eldridge Distributors, Inc., Massachusetts.
Brochure-Arrow 83, Arrow Tualatin, Inc., Oregon.
Brochure-Morbark 4-way Log Splitter, Morbark.
Brochure-Commercial Firewood Processor-CMC Technology, Inc., New Hampshire.
Brochure-FM-50 & FM-50/FP, Cord King of Canada, Inc., Canada.
Article-Slasher Deck, Lumber Systems, Inc., 8/86.
Brochure-Kisa Wood-Combi., Kolefores Maskin AB 11/28/86.
Brochure-Le Chevalet Universel Minirisque, France.
Letter-Firewood Processor, Industries Tanquay, Inc., Canada, 10/14/86.
Brochure-Tuffee, L-M Equipment Company, Inc., Oregon.
Brochure-Firewood Processors, Emerald Steel Fabricators, Inc., Oregon, 6/29/86.
Letter and brochure-Firewood Manufacturing Equipment, Applied Woodtech Engineering, Inc., Oregon, 3/5/85.

*Primary Examiner*—W. Donald Bray
*Attorney, Agent, or Firm*—Wood, Herron & Evans

[57] ABSTRACT

A wood processor is disclosed for cutting a log into a series of shorter lengths and subsequently splitting the shorter lengths into individual pieces of firewood or the like. The processor includes a carriage for receiving the log. Clamps engage the log from both sides to secure it in the carriage which advances the log into contact with a plurality of parallel rotating saws. After the carriage is retracted a pusher rod moves the cut log pieces along an axis onto a plurality of cradle members, one cradle supporting each log section. The cradle members are tilted to dump the log sections alternately onto opposite sides of the axis of log movement. The logs dumped from the cradles are fed to a plurality of individual hydraulically operated log splitters.

19 Claims, 11 Drawing Sheets

HIGH PRESSURE SYSTEM

LOW PRESSURE SYSTEM

FIREWOOD PROCESSOR

BACKGROUND OF THE INVENTION

This invention relates to wood processing machines and is particularly directed to a self-contained processing machine for cutting logs and automatically splitting the cut logs into individual wedge shaped pieces suitable for use as firewood. Over 60 years ago the need was recognized to provide a mechanized machine for sawing lengths of wood into shorter pieces and splitting those shorter pieces into individual pieces of a size that could be utilized for firewood or the like.

One early form of saw and splitter powered by an internal combustion engine is disclosed in Anderson U.S. Pat. No. 1,598,695. . Since that time many different forms of log processors utilizing power saws and hydraulic splitters have been proposed. However, these wood processors have all been subject to one or more shortcomings. One primary disadvantage of prior art processors is that they have a relatively low rate of production, for example, from two to four cords per hour. Another shortcoming is that the processors are susceptible of frequent breakdowns, mostly because of operator pressure, which substantially reduce their total output. In addition, many prior art processors have been relatively unsafe in operation.

Among the patents which disclose wood processors, a power saw and hydraulic splitters is Connolly et al. U.S. Pat. No. 4,286,683. This patent shows a processor in which a log is advanced to a cutting position and is cut by a single movable saw which severs the end section of the log. As each end piece is severed it is transferred by an oscillating transfer member to one of two hydraulic splitters.

Johnson U.S. Pat. No. 4,478,263 discloses a log processor in which a plurality of spaced saws cut off multiple sections of a log. These sections are dropped into a splitter mechanism which sequentially splits the logs into firewood.

Another form of log processing machine including a power driven saw and splitter is disclosed in Smith U.S. Pat. No. 4,269,242. In this processor a movable saw cuts off an endwise piece of a log. The cut piece is then dropped onto a hydraulic splitter which splits the cut piece into firewood sections.

Another firewood processor which includes a power saw for cutting off the endwise section of a log and feeding that section to a hydraulic splitter is shown in Heikinnen U.S. Pat. No. 4,173,237.

Each of these processors is subject to one or more of the disadvantages described above.

SUMMARY OF THE PRESENT INVENTION

The present invention is predicated in part upon the concept of providing a log splitter in which an elongated log, for example, a log of eight feet in length is sawed in several places simultaneously to divide the log into a series of shorter pieces. These pieces are then transferred to a plurality of tiltable cradles which dump the pieces to a plurality of hydraulic splitters which split the shorter sections into firewood. In accordance with the present invention multiple logs are processed simultaneously; i.e., while one log is being sawed the cut sections of the preceding log are transferred to the splitters and split into firewood sections.

One object of the present invention is to provide a firewood processor which has a substantially higher rate of production than has previously been achieved. One preferred form of processor constructed in accordance with the present invention can cut and split approximately ten cords of firewood per hour. Moreover, this high rate of production is achieved utilizing only a minimum amount of manpower, i.e. two men, to load the logs into the processor. The operation of the processor once the logs have been loaded is completely automatic.

A preferred form of processor embodying the present invention comprises a movable carriage which receives an uncut log. The carriage includes a plurality of clamps which clamp the log in position. The carriage is then shifted transversely toward a plurality of spaced rotary saw blades which cut the log into individual sections. After the log has been cut the carriage is retracted to its original position and the log sections are unclamped. A feed ram then pushes the cut log sections along an axis onto a plurality of cradles, one cradle supporting each cut log section. The cradles are then tilted transversely with alternate cradles dumping logs on opposite sides of the axis of log movement. The individual logs are thus deposited either directly or by means of a chute into a plurality of separate hydraulically operated splitters disposed on opposite sides of the axis of log movement. The hydraulic splitter devices are activated to split the short log sections into individual wedges of firewood. After the first log has been cut and fed onto the cradle sections a second log can be loaded onto the carriage and sawed into shorter pieces. In a preferred embodiment of the present invention an eight foot section of log can be converted into 36 firewood pieces in approximately 70 seconds. After the initial log has been processed the processor converts an eight foot log with 36 additional firewood pieces every 31 seconds.

In addition to its high rate of production another advantage of the present wood processor is that it is extremely durable and has a relatively low repair frequency. Moreover, the construction of a processor is such that the most vulnerable of components, i.e. the saw blades, bearings and splitter knife blades, can be individually removed and quickly replaced.

It is one concept of the present invention to utilize saw blades which rotate about a fixed shaft which is connected directly to the power source, i.e., an internal combustion engine or an electric motor. The log is advanced past the saws by a hydraulically operated carriage. The fluid pressure in the carriage drive ram controls the pressure on the saw blade and a flow rate volume controls the rate of feed of the log to the blades.

A still further advantage of the present invention is that the wood processor is extremely safe in operation. After a log has been loaded no intervention or control by an operator is required. In a preferred embodiment the rotary saws are mounted in a housing which completely encloses the saws except for a small opening through which the carriage and logs are introduced to and withdrawn from the saw area. The overall safety of the unit is further enhanced by the fact that each operation of the unit can commence only upon successful completion of the previous operation. Thus, if any one component of the machine should fail the machine automatically stops its operation.

A still further advantage of the present invention is that it produces firewood of high uniformity. More particularly, the log splitter is constructed to automatically center each log relative to the splitter blades so that the center of the log is substantially aligned with the center of the radial blades and uniform individual firewood pieces are produced irrespective of the diameter of the log.

Yet another advantage of the present invention is that the power required to operate the hydraulic splitters is reduced by utilizing a novel splitter blade construction. More particularly, the splitter assembly includes a plurality of blades extending radially outwardly from a center pin. The ends of these blades are supported by means of tie rods extending parallel to the direction of movement of the splitter ram. The construction materially decreases the thickness needed for the blades and consequently reduces the force which must be applied by the ram against the log and the stress on the splitter blade supports.

These and other objectives and advantages of the present invention will be more readily apparent from a consideration of the following detailed description of the drawings illustrating a preferred embodiment of the invention.

DESCRIPTION OF A PREFERRED EMBODIMENT

Figure 1:
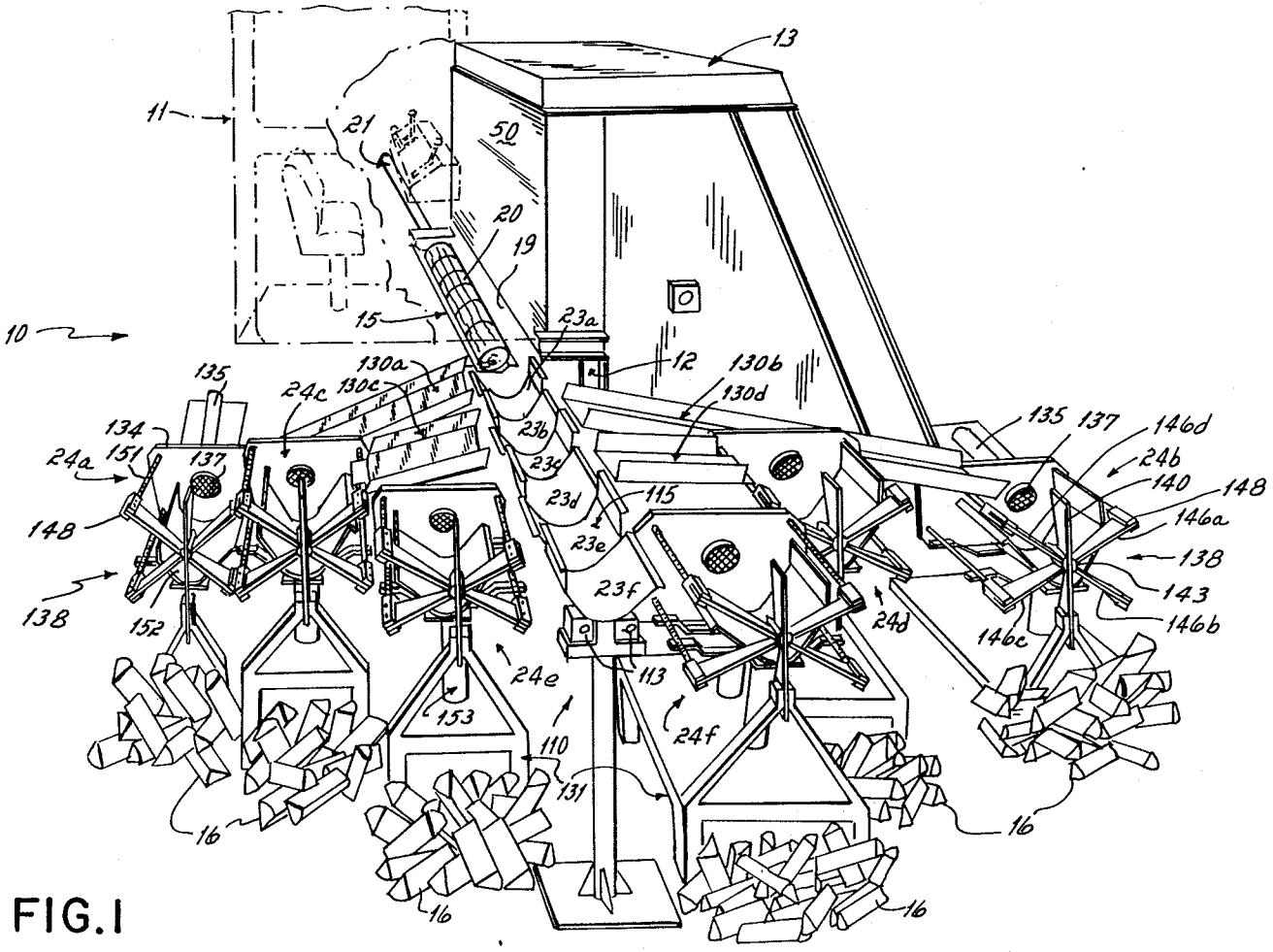
FIG. 1 is a perspective view of a firewood processor constructed in accordance with the principles of the present invention.
Figures 2, 2A:
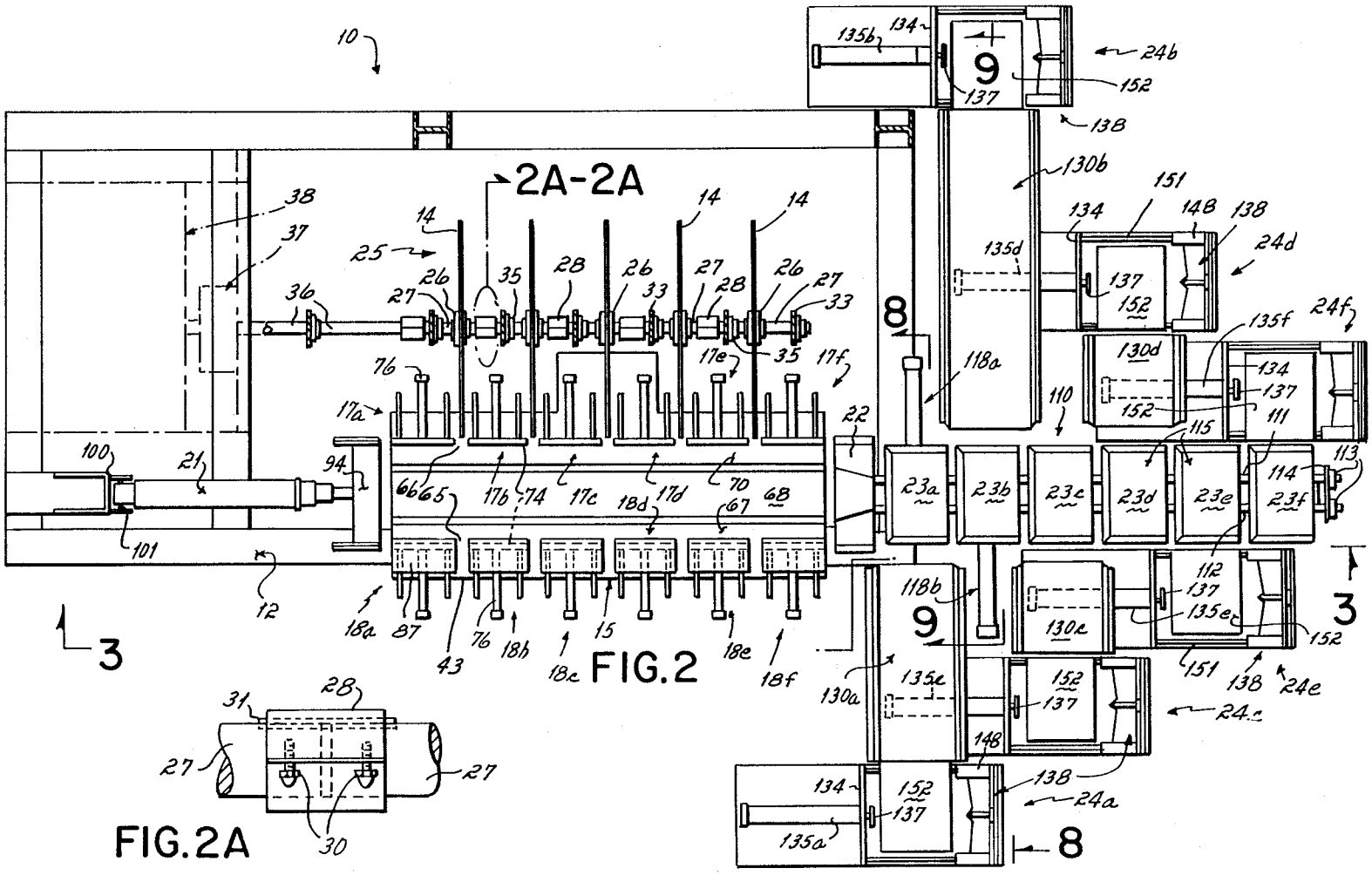
FIG. 2 is a top plan view of the firewood processor.
FIG. 2A is an enlarged view of the encircled area 2A of FIG. 2.
Figure 3:
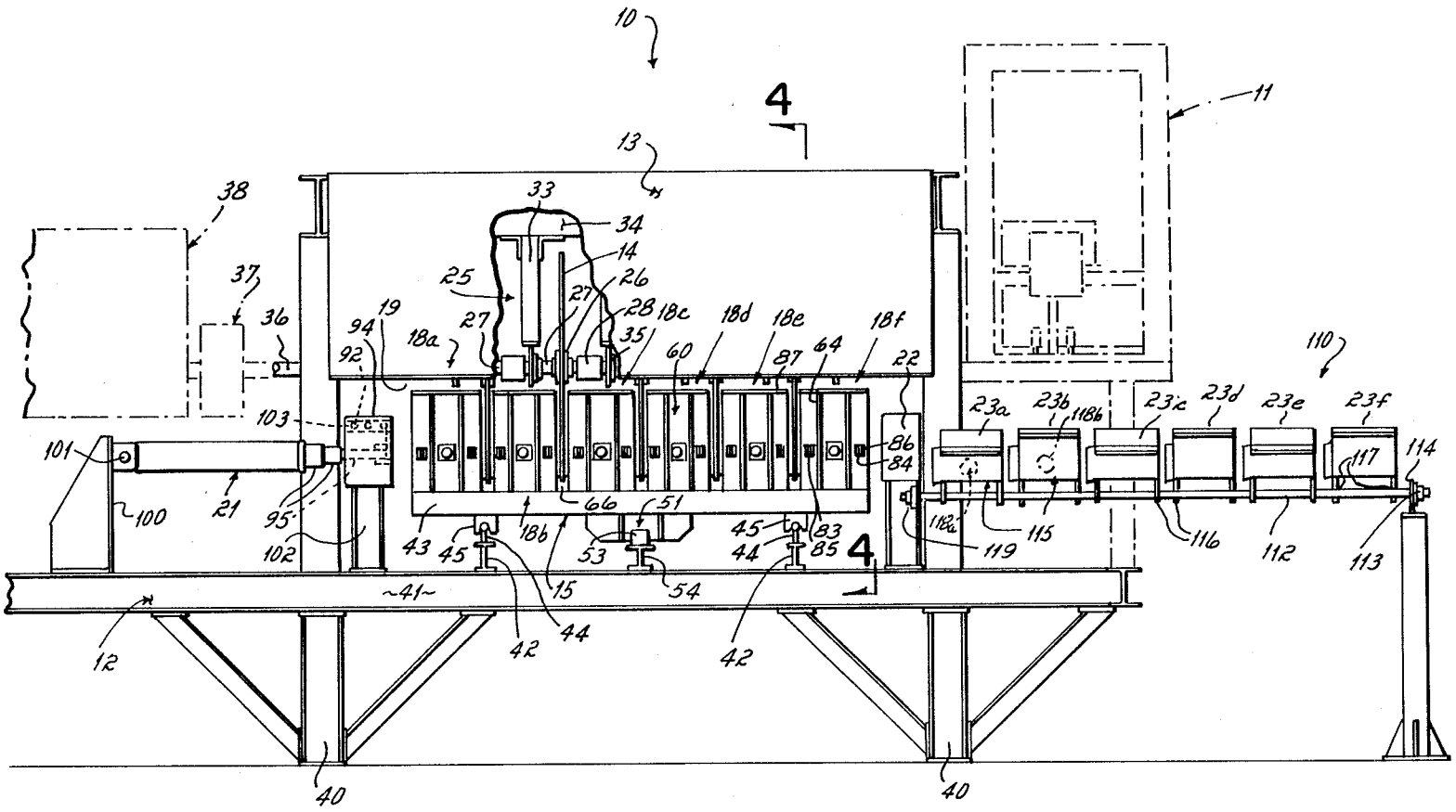
FIG. 3 is a view taken along line 3—3 of FIG. 2.

The overall construction of a preferred embodiment of a wood processor 10 constructed in accordance with the principles of the present invention is best shown in FIGS. 1-3. As there shown the processor includes an operator station 11 from which an operator can control operation of the processor and a base 12 for supporting various components of the processor. A housing 13 encloses a plurality of parallel spaced rotary saw blades 14. A transversely movable carriage 15 is mounted adjacent to the saw blades. This carriage is adapted to support a log 20, for example, a log of 8 feet in length, the log being clamped in position by opposing pairs of clamps **17*a*–17*f* and 18*a*–18*f*. When the carriage with a log clamped in place is advanced in a transverse direction toward the saw blades, the log 20 enters housing 13 through an elongated opening 19 and clamps 17*b*–17*e* pass between adjacent saw blades 14 while end clamps 17*a* and 17*f* pass along the outer edges of end blades 14. Saw blades 14 are effective to saw a log 20 into a plurality of shorter sections, for example, six 16 inch sections as illustrated in FIG. 1**.

The wood processor 10 further comprises a longitudinal pusher ram 21 for forcing the cut log sections through a funnel member 22 and onto cradles **23*a*–23*f*. The cradles are adapted to be tilted in alternately opposite directions so that cut log sections are fed to splitter devices 24*a*–24*f*, three of which are disposed on each side of the axis of pusher ram 21. Thus as viewed in FIG. 1, cradle 23*a* feeds a log section to splitter 24*a* on the left side of the axis of ram 21 while cradle 23*b* feeds a log section to splitter 24*b* on the right hand side of the axis of ram 21. Similarly, cradle 23*c* displaces a log section to the left into splitter 24*c* while cradle 23*d* displaces a log to the right into splitter 24*d*, cradle 23*e* displaces a log to the left into splitter 24*e* and cradle 23*f* displaces a log to the right into splitter 24*f*. The splitter devices 24*a*–24*f* are spaced longitudinally along the path of travel of log 20 and are disposed at varying distances from the axis of ram 21. Each splitter device is effective to split each previously sawed length of log 20 into six wedgeshaped pieces of firewood 16**.

In the preferred embodiment, the cradles **23*a*–23*f* are tilted simultaneously so that the log sections are fed simultaneously to splitter devices 24*a*–24*f***. The splitters may either operate simultaneously or in groups to reduce the power required. In any case the splitters can be operated while another log is being sawed. This contributes greatly to the high rate of production of the present wood processor.

The details of the saw assembly 25 are best shown in FIGS. 1-4. As there shown saw assembly 25 comprises five circular saw blades 14. The saw blades are disposed parallel to one another and are spaced apart a distance equal to the desired length of the cut log sections, for example, 16" in a preferred embodiment. The saw blades are completely enclosed in housing 13 except for opening 19 through which logs are fed to the saws.

Saw blades 14 are constructed and mounted so that each saw blade may be independently replaced. The construction and monitoring of each of the saw blades is identical so that only one will be described in detail. More particularly, each saw blade includes a hub 26 mounted on a short stub shaft 27 which extends transversely on each side of the saw blade. The axes of each of the shafts 27 is concentric. The ends of shafts 27 of adjacent saw blades 14 are interconnected by means of a split sleeve coupling 28. The sleeve embraces the ends of the two opposing shafts 27 and the split sleeve is tightened by means of bolts 30. As shown in FIG. 2A sleeve 28 and each of the shafts 27 are provided with keyways for receiving a key 31 which provides a positive driving connection from one shaft 27 to the next shaft. It will be appreciated that when bolts 30 are loosened and sleeves 28 are disengaged from the shaft 27 associated with one blade, that blade may be removed without disturbing adjacent blades. Shafts 27 are supported by means of depending brackets 33 carried by a horizontal elevated beam 34. Each of the brackets 33 carries a bearing 35 adjacent to its lower end which supports one of the shafts 27. A drive shaft 36 is connected to the end most shaft 27 by means of one of the coupling sleeves 28. Drive shaft 36 is connected through a clutch 37 of any suitable construction to the output shaft of an internal combustion engine 38 or an electric motor.

The details of construction of the carriage 15 are best shown in FIGS. 2–7. More particularly, the carriage 15 is supported from base 12 for transverse movement toward and away from saw blades 14. As shown in FIG. 3 base 12 comprises a plurality of vertical support members 40 which carry longitudinal I beams 41. Longitudinal I beams 41 in turn carry transverse I beams 42. These transverse I beams are disposed beneath saw blades 14 and are spaced from one another along longitudinal I beams 41. Carriage 15 comprises a platform 43 which is guided for transverse movement by two rails 44 carried by I beams 42. More particularly, two depending guide members 45 are mounted beneath platform 43 and include downwardly facing grooves which ride along the cylindrical upper surfaces of the guide rails 43.

Figure 4:
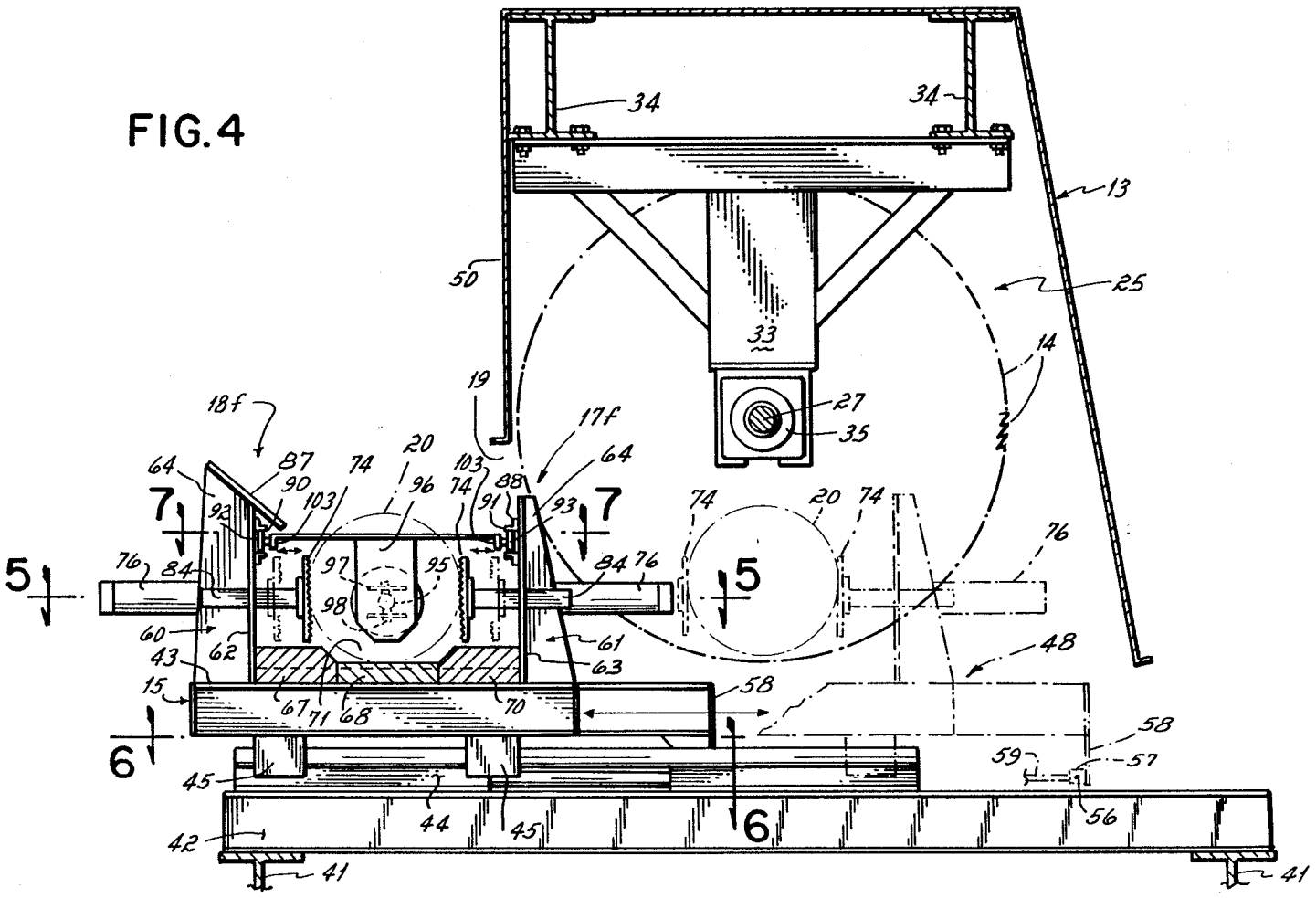
FIG. 4 is a cross-sectional view taken along line 4—4 of FIG. 3.

Carriage 15 is shiftable between a load-unload position illustrated in FIGS. 1, 2, and 4 to an advanced or sawing position illustrated by dotted lines 48 in FIG. 4. In the load-unload position the carriage is withdrawn from housing 13 so that a log 20 is disposed to the left, i.e. outwardly, of front wall 50 of the housing. This permits a log to be loaded into the carriage or to be shifted longitudinally of the carriage without interference from the saw housing 13. In the advanced or sawing position the carriage is shifted to the right in FIG. 4 so that it is advanced to a position in which its center line is in substantial vertical alignment with the center line of the saw blades so that the saw blades have passed completely through the log.

Figure 5:
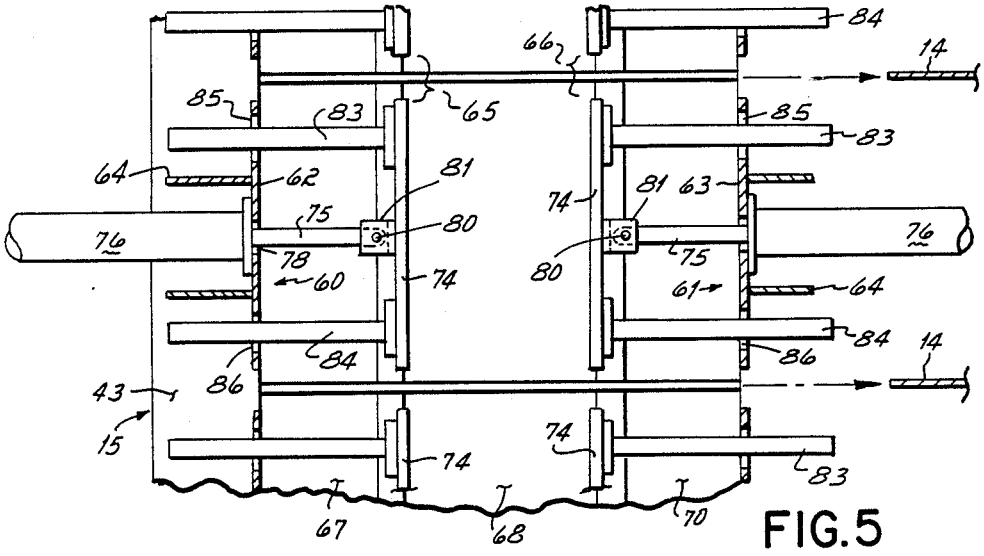
FIG. 5 is a cross-sectional view taken along line 5—5 of FIG. 4.
Figure 6:
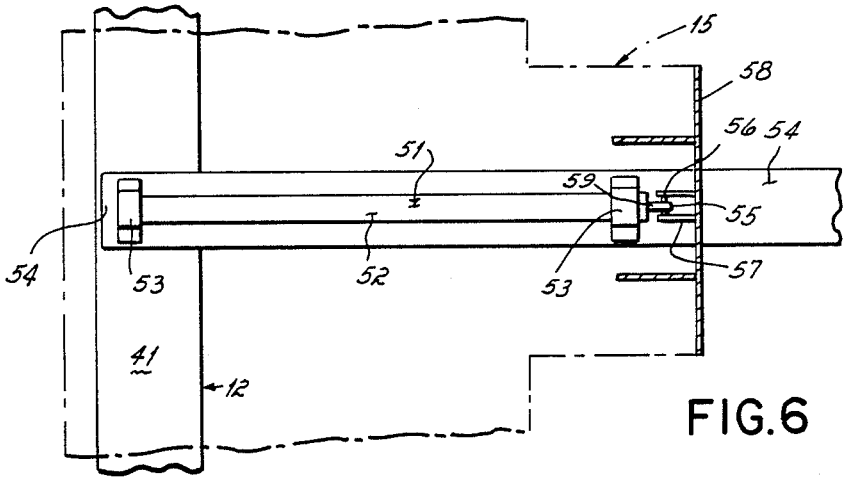
FIG. 6 is a cross-sectional view taken along line 6—6 of FIG. 4.
Figure 7:
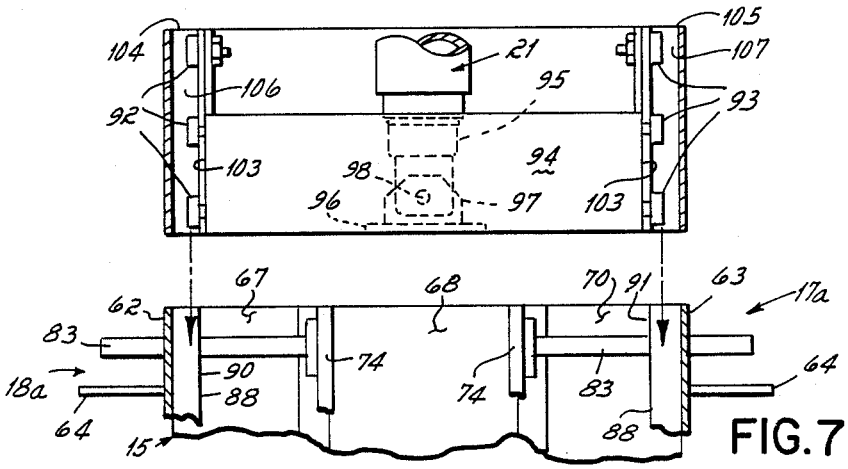
FIG. 7 is a cross-sectional view taken along line 7—7 of FIG. 4.
Figure 8:
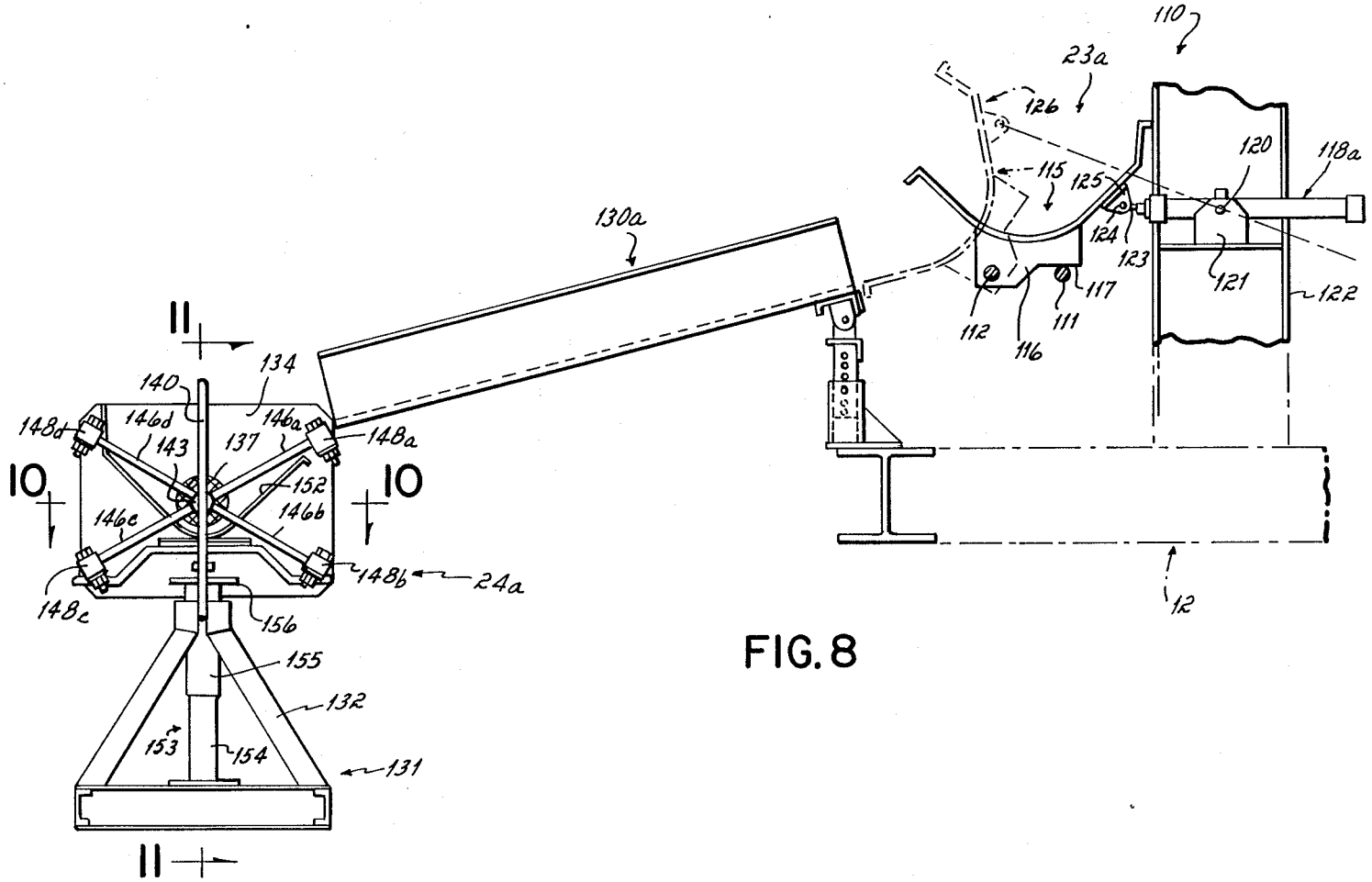
FIG. 8 is a cross-sectional view taken along line 8—8 of FIG. 2.
Figure 9:
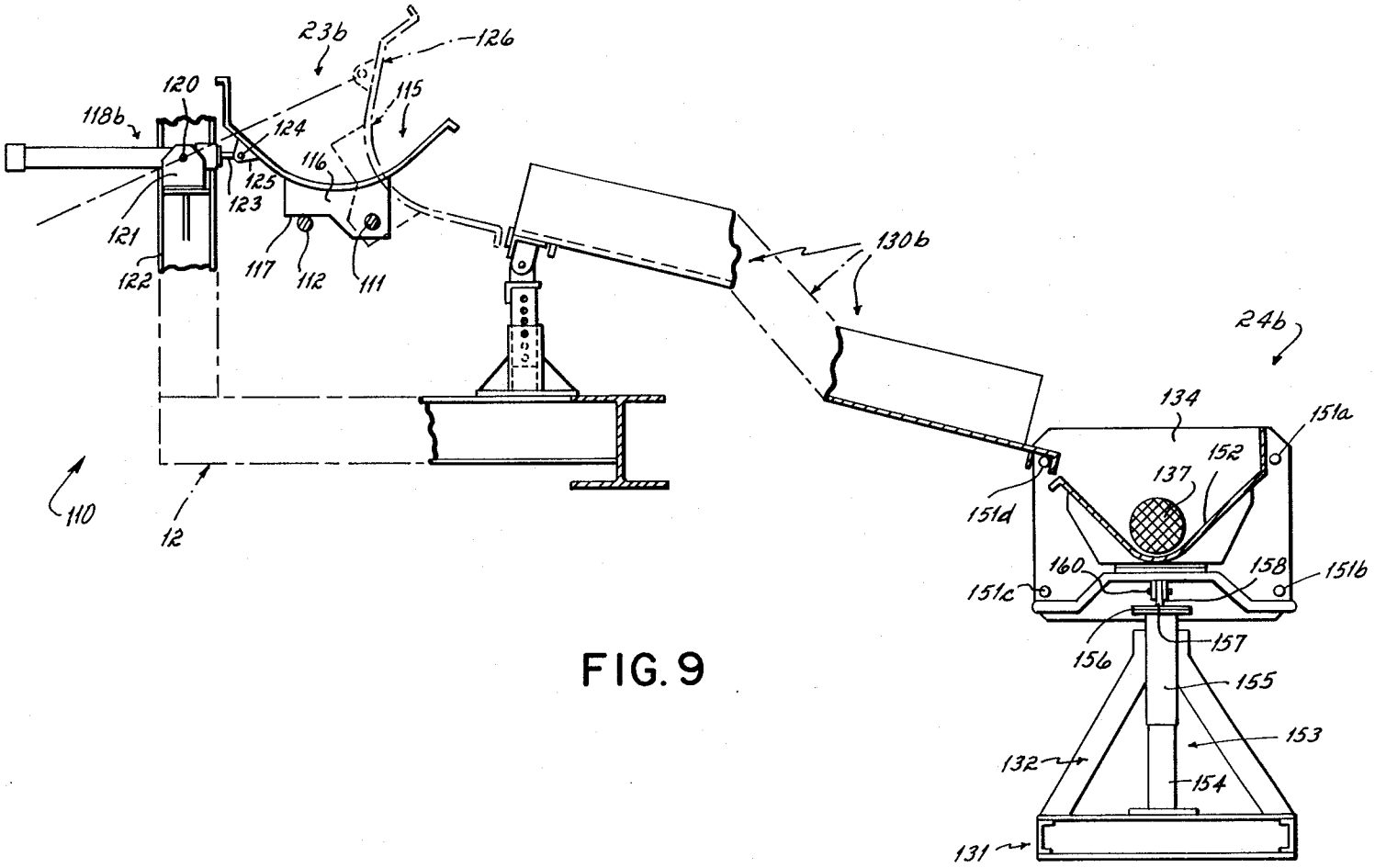
FIG. 9 is a cross-sectional view taken along line 9—9 of FIG. 2.
Figure 10:
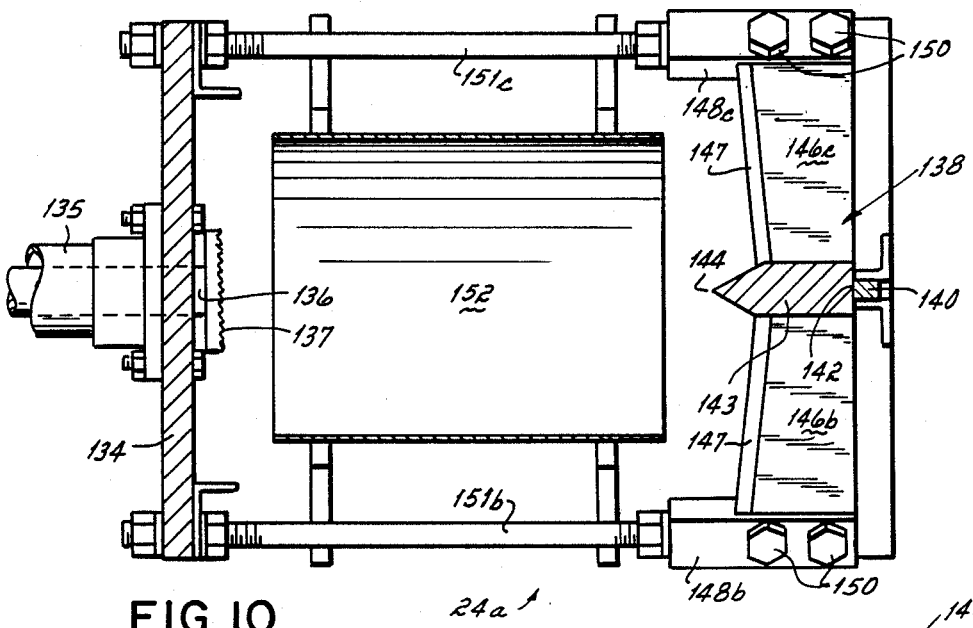
FIG. 10 is a cross-sectional view taken along line 10—10 of FIG. 8.

Transverse movement of carriage 15 is controlled by a hydraulic piston and cylinder assembly 51. As shown in FIG. 3 and 5 a hydraulic cylinder 52 is mounted by means of brackets 53 on a transverse I beam 54 which is in turn supported by longitudinal I beams 41 of the base member 12. The piston rod 59 associated with cylinder 52 carries an eye member 55 which receives a pin 56 carried by brackets 57 mounted on wall 58 of the carriage. When piston rod 59 is advanced carriage 15 is shifted to the right in FIGS. 1–4 to the sawing position and when the piston rod 59 is retracted the carriage is returned to the left to the load-unload position.

The upper surface of platform 43 of the carriage 15 supports a plurality of vertical brackets 60 and 61. Brackets 60 are longitudinally spaced along one edge of platform 43 while brackets 61 are longitudinally spaced along the opposite edge of shelf 43. Each of the brackets 60 includes a vertical wall 62 while each of the brackets 61 includes a vertical wall 63. Suitable gussets 64 are provided to stiffen and support these walls. It is to be understood that the adjacent brackets are spaced sufficiently as indicated at 65 and 66 to permit a saw blade 14 to pass between the vertical walls of adjacent brackets. A plurality of log support strips 67, 68 and 70 are mounted along the upper surface of platform 43. Center strip 68 is of a lesser height than side strips 67 and 70 and the inner edges of these latter strips are chamfered to provide a longitudinal log supporting groove 71. In the preferred embodiment strips 67, 68 and 80 are formed of wood.

Vertical support brackets 60 and 61 respectively carry side log clamp mechanisms **17*a*–17*f* and 18*a*–18*f*. These clamp mechanisms are substantially identical with one another and only one will be described in detail. Each clamp mechanism comprises a serrated vertical clamp plate 74 mounted on the free end of a piston rod 75 forming part of a hydraulic cylinder assembly 76. Cylinder 76 is mounted upon vertical wall (62 or 63) carried by platform 43. Piston rod 75 extends forwardly through an opening 78 formed in the wall. Plate 74 is mounted upon the end of piston rod 75 for pivotal movement about a vertical pin 80 which is mounted in brackets 81 and passes through an eye member secured to the end of piston rod 75. Plate 74 carries two end rods 83 and 84 which extend rearwardly from plate 74 and pass through openings 85 and 86 in wall 62 or 63. When piston rods 75 are advanced by the application of pressure to cylinder 76 plates 74 engage opposite sides of log 20. Since these clamping jaw's plates 74 are free to pivot about pins 80 the clamping jaws accommodate themselves to irregularities, e.g. bends, in the log. Again, it is to be understood that the opposing side edges of adjacent plate 74 are spaced a sufficient distance apart to permit a saw blade 14 to pass between the jaws when the carriage 15** is advanced into the sawing position.

In addition to these elements vertical support brackets 60 carry a downwardly sloping top plate 87 which protects the left side clamping plates 74 when the plates are in their retracted position during loading of log 20. Spaced angle members 88 are mounted upon the surfaces of vertical walls 62 and 63 to form longitudinal tracks 90 and 91. Tracks 90 and 91 support and guide rollers 92 and 93 carried by plate 94 mounted upon the free end of telescoping piston 95 of pusher cylinder 21. Plate 94 carries a depending vertical plate 96 which is disposed to engage the end of log 20 when the piston rod 95 is advanced. Vertical plate 96 carries two flanges 97 which engage a vertical pin 98 that passes through an opening provided in the end of the piston rod.

As shown in FIG. 3 the end of cylinder 21 is mounted upon vertical post 100 by means of pin 101. A second post 102 is disposed between the opposite end of cylinder 21 and the end 103 of carriage 15. The second post 102 carries two spaced vertical side plates 104 and 105 which carry on their inner surface guideways 105 in vertical alignment with tracks 90, 91 formed on the carriage assembly. Thus, when telescoping piston rod 95 is fully retracted the free end of the piston rod is supported by the engagement of rollers 92 and 93 with guideways 106, 107 associated with post 102. However, as the piston rod 95 is extended, rollers 92 and 93 move into engagement with tracks 90 and 91. In its most advanced position piston rod 95 shifts vertical pusher plate 96 to a position closely adjacent to funnel member 22. During this advancing motion pusher plate 96 is effective to advance the segments of log 20 through funnel 22 and onto cradle members **23*a*–23*f*** with one log segment being disposed on each of the cradle members.

The construction of cradle assembly 110 is best shown in FIGS. 2, 3, 8 and 9. As there shown cradles **23*a*–23*f* are mounted upon two longitudinal shafts 111 and 112. These shafts are spaced transversely and are preferably in the same horizontal plane. The ends of the shafts are journaled in bearings 113 carried by vertical support plate 114 and by a second set of bearings 119 (FIG. 3) mounted adjacent to funnel member 22. Each of the cradle members is in the shape of an inverted trough 115 and includes a combined mounting and stop block 116 extending downwardly from the under surface of the cradle member. Each of the blocks 116 is provided with a transverse bore for receiving one of the shafts 111 or 112. It is to be understood that each of the blocks is rigidly secured to the its respective shaft in any suitable manner such as by means of a set screw (not shown). Additionally, the blocks 116 include a horizontal abutment shoulder 117 adapted to engage the opposite shaft, e.g. shaft 111 in FIG. 8, to support the cradle with the bottom of its trough in a generally horizontal position. It is to be understood that in the embodiment illustrated cradles 23***a*, 23*c* and 23*e* are rigidly secured to shaft 112 while cradle 23*b*, 23*d* and 23*f* are rigidly secured to shaft 111.

The cradles are pivoted by means of hydraulic cylinders 118*a* and 118*b*. Hydraulic cylinder 118*a* is pivotally supported by means of pin 120 carried by brackets 121, the brackets in turn being carried by vertical post 122 mounted upon the base assembly. The piston rod 123 associated with cylinder 118*a* carries an eye member which receives pin 124 carried by brackets 125 secured to the under surface of cradle trough member 115. When piston rod 123 is retracted cradle 23*a* is positioned in its "loading", or generally horizontal position illustrated in FIG. 8. However, when piston rod 123 is advanced cradle 23*a* is tilted to a generally vertical or "discharging" position illustrated by dotted lines 126 in FIG. 8. It is to be understood that when cradle 23*a* rotates it in turn rotates shaft 112 causing cradles 23*c* and 23*f* to be pivoted in a manner similar to cradle 23*a*. It is further to be understood that piston rod 123 is preferably advanced at a rapid rate causing logs to be "thrown" from cradle 23*a*, 23*c* and 23*f*. When the piston rod 123 is retracted the cradles are returned to their loading position with abutment shoulder 117 resting upon shaft 111.

A second cylinder 118*b* mounted and constructed in a manner similar to cylinder 118*a* has a piston rod connected to cradle 23*b*. Hydraulic cylinder 118*b* is effective to tilt cradles 23*b*, 23*d* and 23*f* in the same manner that cylinder 118*a* tilts cradles 23*a*, 23*c* and 23*e*.

When a log segment is discharged from cradle 23*a* it is deposited in a downwardly sloping feed chute 130*a*. This feed chute delivers the log to splitting device 24*a*. Similarly, log sections discharged from cradle 23*b* are dropped into downwardly sloping feed chute 130*b* from which the logs drop into splitter device 24*b*. Logs discharged from cradle 23*c* drop into chute 130*c* from which the logs are fed to splitter device 24*c*. Logs are discharged from cradle 23*d* into chute 130*d* and are fed by that chute to splitter device 24*d*. In the preferred embodiment cradle 23*e* discharges logs directly into splitter device 24*e* while cradle 23*f* discharges logs directly into splitter device 24*f*.

The details of the splitter devices 24*a*–*f* are best shown in FIGS. 1 and 8–11. It is to be understood that the splitter devices are substantially identical so that only splitter device 24*a* will be described in detail. Splitter device 24*a* comprises a base 131 including an endwise support posts 132 and 133. Post 133 carries an end-plate 134 which supports a hydraulic cylinder 135. The piston rod 136 associated with cylinder 135 carries on its free end a serrated ram plate 137. It is to be understood that piston rod 136 extends through an opening provided in end-plate 134 so that ram 136 is effective to shift plate 137 from a retracted position shown in FIG. 11 to an advanced position adjacent to a blade assembly 138 carried by post 132.

Figure 11:
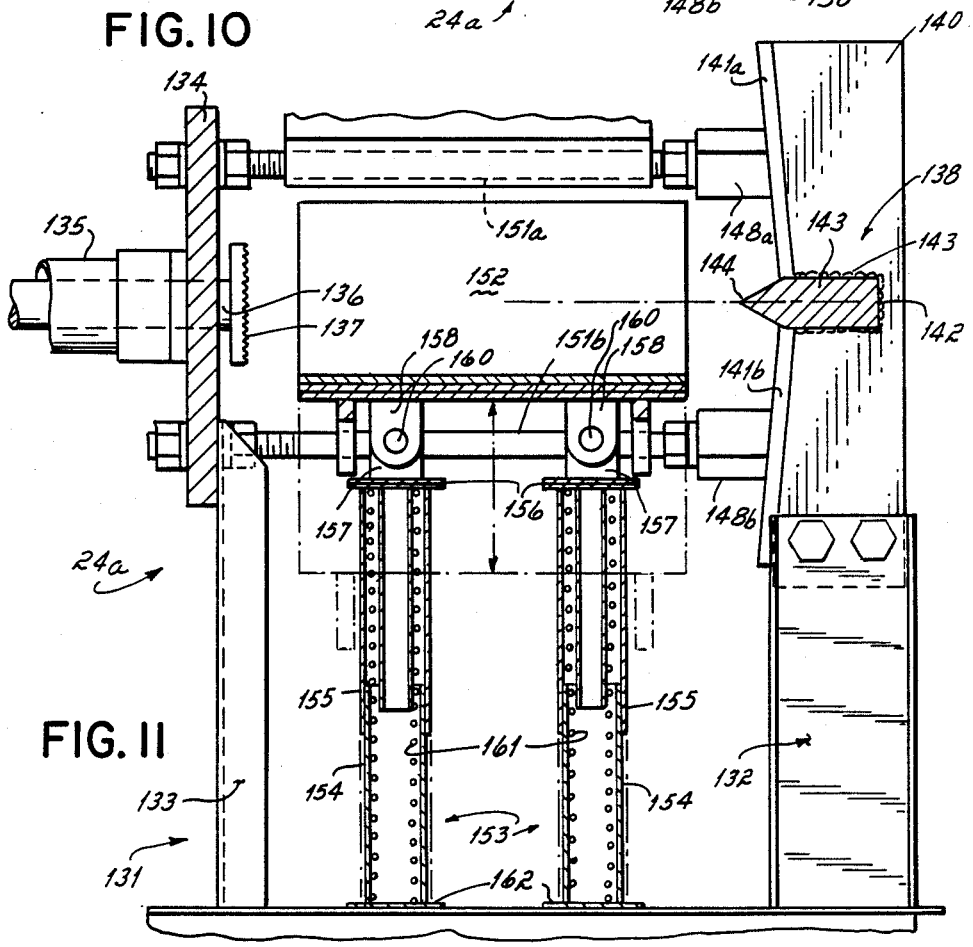
FIG. 11 is a cross-sectional view taken along line 11—11 of FIG. 8.

Blade assembly 138 includes a vertical blade 140 having sharpened and tapered edges 141*a* and 141*b* facing ram plate 137. As shown in FIG. 11 vertical blade 138 is provided with a slot 142 for receiving a tapered center pin 143. Pin 143 is preferably formed of hexagonal stock with a conical tapered point 144 facing ram 137. Two opposing faces of the hexagonal body of pin 143 are welded to knife blade 138 as indicated at 145.

Four other blades 146*a*–*d* are disposed at 60° angles and extend outwardly from center pin 143 with the inner ends of the knife blades 146*a*–146*d* preferably being welded to faces of the hexagonal body of pin 143. Each of the blades 146*a*–146*d* includes an inwardly tapered sharpened edge 147 facing ram plate 137. The outer edge of each of the blades 146*a*–146*d* is received within a slot in one of the blocks 148*a*–148*d*. The blade is rigidly secured to the block by means of bolts 150. Blocks 148*a*–148*d* include threaded bores adapted to received tie rods 151*a*–151*d*. The tie rods extend between blocks 148*a*–148*d* and end plate 134. These tie rods are effective to support the free ends of blades 146*a*–146*d* when a log is pressed against these blades by action of the ram plate 137.

Each of the splitter devices 24*a*–24*f* further includes a trough member 152. Trough member opens upwardly and is effective to support a cut section of log 20. It is to be understood that the center section of the log is supported in trough section 152 while the maximum spacing between ram plate 137 in its retracted position and the tip of pin 143 exceeds the length of the log. Thus, the ends of the log are free of engagement with these members and the log is free to move between these two members. Trough 152 is mounted for vertical movement upon telescoping cylinders 153. Each of these cylinders includes a lower section 154 mounted upon base 131 and an upper cylindrical section 155 which telescopes over the lower section. Upper cylindrical section 155 includes a top plate 156 which carries upstanding brackets 157 connected to depending brackets 158 secured to the trough member 152 by means of pins 160. A compression spring 161 is compressed between the bottom wall 162 of lower cylinder 154 and top plate 156 of the upper cylinder section. It is further to be understood that a suitable orifice is provided for controlling escape of air from the interior of cylinders 154 and 155. As a result of this construction telescoping cylinders 153 and springs 161 in effect "weigh" each log deposited in the trough 152 so that each log is automatically positioned with its center in substantial alignment with pin 143. In other words, larger, heavier logs compress springs 161 to a greater degree and hence lower trough 152 to bring the center of the larger log into alignment with pin 143. On the other hand, a lighter log of smaller diameter compresses springs 161 to a lesser degree so that the trough is held at a more elevated position to again position the center of the smaller log in substantial alignment with the head of pin 143. This provides a substantial improvement in the uniformity of the firewood segments 25 produced by the splitters.

Figure 12:
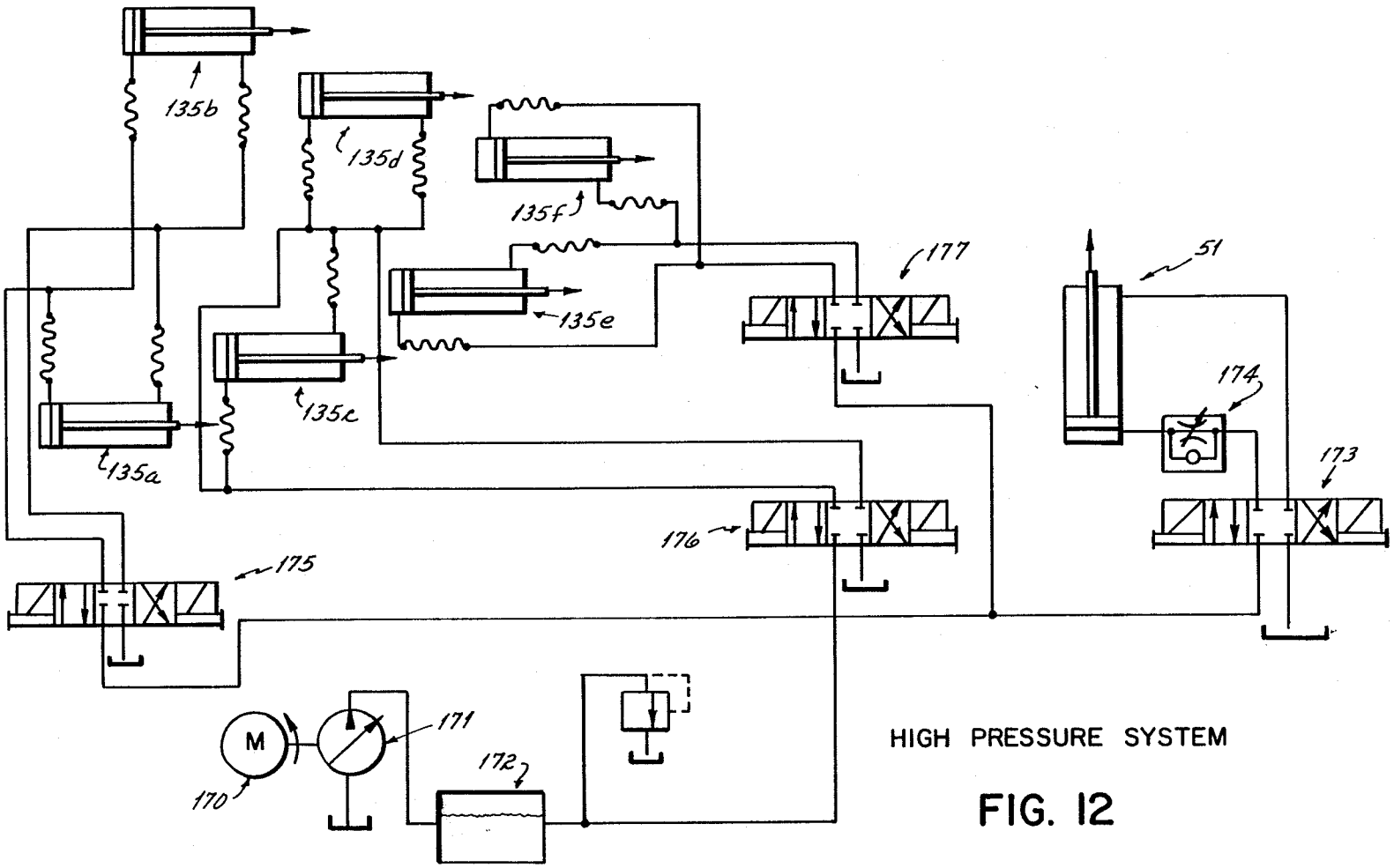
FIG. 12 is a schematic hydraulic circuit diagram of the high pressure portion of the hydraulic circuit used in conjunction with the firewood processor.
Figure 13:
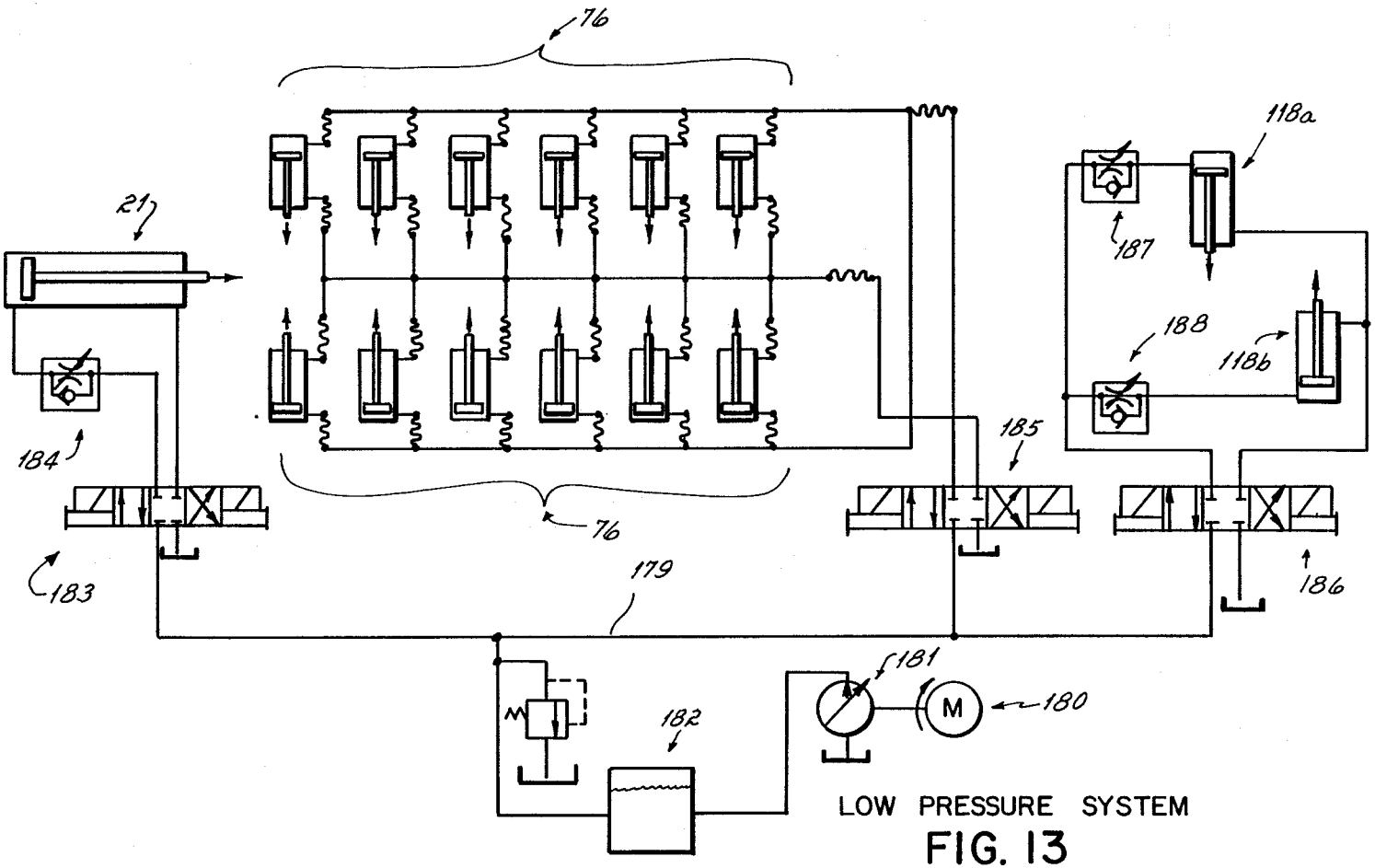
FIG. 13 is a schematic hydraulic circuit diagram of the low pressure portion of the hydraulic circuit used in connection with the firewood processor.
Figure 14:
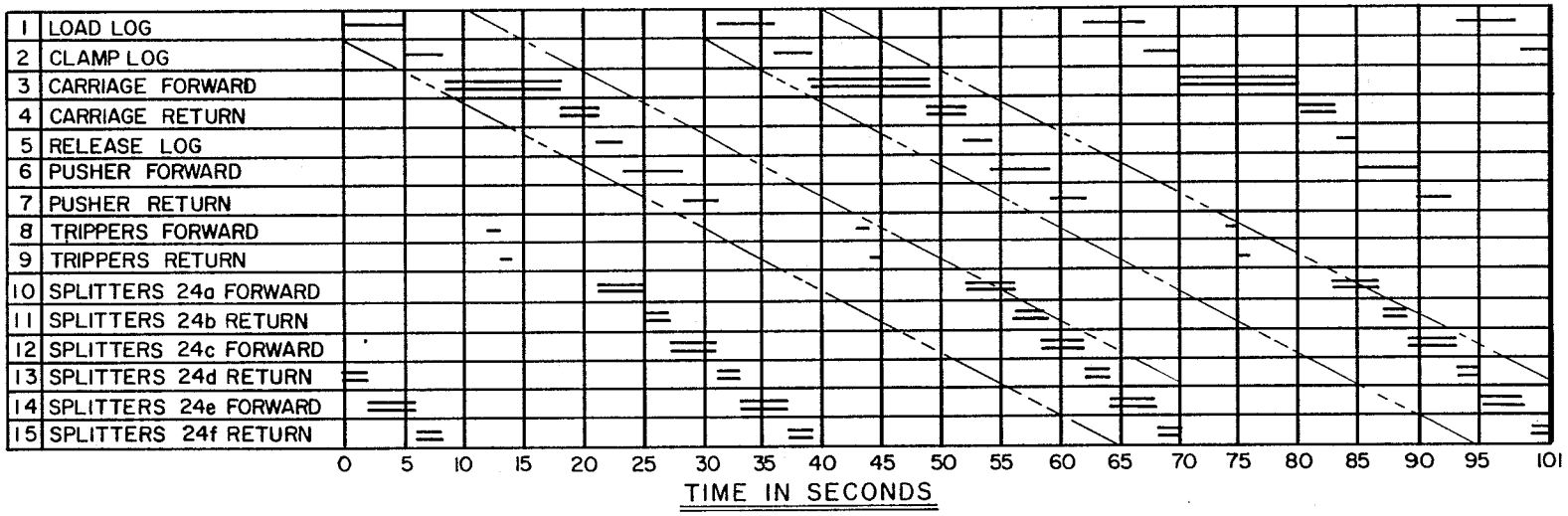
FIG. 14 is a diagram showing the sequence of operations.

The hydraulic circuits utilized in connection with the preferred embodiment of log splitter are illustrated in FIGS. 12 and 13 and a sequence diagram for the operation of the various components of the processor is illustrated in FIG. 14. The basic principles of hydraulic circuits for operating power cylinders and the like are well known to those skilled in the art. Accordingly, it is not considered necessary to describe the hydraulic circuits in complete detail. Additionally, controls for sequencing the operation of the various devices are well known to those skilled in the art. Such controls can take the form of mechanical devices such as limit switches or can take the form of micro-processor controls. The exact mechanical or electrical construction of these controls constitutes no part of the present invention. However, in order to illustrate the sequencing of operation of the components of a preferred form of processor, a control will be described utilizing mechanically generated switching components which are well known and are not illustrated.

More particularly, a preferred form of processor utilizes two separate pressure systems, a high pressure system and a low pressure system. The high pressure system is preferably operated at a pressure of the order of 3000 psi while the low pressure system is operated at a pressure of the order of 400 psi. It will of course be appreciated that hydraulic systems operating at other pressures can be employed if desired.

The construction of the high pressure system is illustrated in FIG. 12. The high pressure system includes a source of power such as an internal combustion engine 170 or an electric motor. This engine drives a pump 171 which supplies a suitable fluid such as oil under pressure to an accumulator 172. Fluid under pressure is supplied from the accumulator 172 to carriage advance cylinder 51 through valves 173 and 174. Valve 173 is a conventional three-position four-connection directional valve having a closed center. Valve 174 is a combined flow rate control and check valve. It is to be understood that valve 173 is electrically operated and is effective to supply pressure to advance the ram associated with cylinder 51 when a signal is received indicating that a log has been clamped on the carriage. Similarly, valve 173 is effective to apply pressure to retract the ram of cylinder 51 after the carriage 15 has reached its fully advanced position. The signal may be generated, for example, by a limit switch which is tripped by the carriage when so advanced.

The high pressure system also is utilized to operate the six hydraulic cylinders 135*a*–135*f* associated with the splitters 24*a*–24*f*. In the preferred embodiment two of these hydraulic splitters are operated simultaneously followed by the operation of a second pair of splitters and then by the operation of a third pair of splitters. More particularly, high pressure fluid is supplied through valve 175 to cylinders 135*a* and 135*b*. Valve 175 is identical with valve 173. It is actuated to apply pressure to advance the rams of cylinders 135*a* and 135*b* at a predetermined time, for example, 10 seconds after cradles 23 have been tilted and returned to their load position or by a weight sensor on the trough. Valve 175 is again actuated to apply pressure to the opposite end of cylinders 135*a* and 135*b* to retract their rams after the rams have advanced a predetermined distance as detected, for example, by conventional limit switch.

In a similar manner valve 176 interconnects a pressure line to cylinders 135*c* and 135*d*. Valve 176 is similar to valve 175 and is energized to advance the rams of cylinders 135*c* and 135*d* after the rams of cylinders 135*a* and 135*b* have been fully retracted as sensed, for example, by a conventional limit switch.

The third pair of cylinders 135*e* and 135*f* are connected to a high pressure line through valve 177 which is similar to valves 175 and 176. Valve 177 is energized to apply pressure to cylinders 135*e* and 135*f* to advance their rams when the rams of cylinders 135*c* add 135*d* are fully retracted as sensed, for example, by a suitable limit switch. Valve 177 is further energized to apply pressure to retract the rams of cylinders 135*e* and 135*f* after the rams of these cylinders have reached the full advance of their stroke as sensed by a suitable device such as limit switch.

The low pressure system is illustrated in FIG. 13. This system is utilized to apply pressure to log pusher cylinder 21, log clamp cylinders 76 and cradle tilting cylinders 118*a* and 118*b*. The low pressure system includes a power source such as an internal combustion engine 180 or an electric motor which may be the same engine utilized to power the high pressure system. Engine 180 drives a low pressure pump, e.g. a 400 psi pump 181, which is connected to an accumulator 182. The accumulator is connected through valves 183 and 184 to log pusher cylinder 21. Valves 183 and 184 are similar in construction and operation to valves 173 and 174, respectively. In a preferred embodiment valve 183 is energized to advance the ram of log pusher cylinder 21 when a switch or other sensor detects that clamp plates 74 have been retracted to release log 20. Valve 183 is again energized to apply pressure to cylinder 21 to retract the ram after that ram has been fully advanced as detected by a limit switch or the like. Pressure line 179 is also connected through valve 185 to clamp cylinders 76. Valve 185 is similar to valve 183 and is energized to advance the rams of the clamp cylinders whenever a switch detects that a log 20 has been loaded onto carriage 15. Valve 185 is again energized to apply pressure to retract the rams of the clamp cylinders when a suitable limit switch or the like detects that carriage 15 has been fully returned to its retracted position.

Pressure line 179 is also connected through valves 186, 187 and 188 to cylinders 118*a* and 118*b* which are effected to tilt cradles 23*a*–23*f*. Valve 186 is similar to valve 183 and valves 187 and 188 are similar to valve 184. Valve 186 is energized to supply pressure to cylinders 118*a* and 118*b* to advance the rams of these cylinders a predetermined time, for example, 5 seconds after the pusher ram 95 has returned to its retracted position as sensed by a limit switch or the like. Valve 186 is again energized to apply pressure to cylinders 118*a* and 118*b* to retract the rams of those cylinders after the rams have been fully advanced as sensed by a suitable limit switch.

The sequence of operation of the processor is best understood from a consideration of FIG. 14. To commence operation of the device a log is loaded onto carriage 15. When the log is positioned on the cradle it actuates a switch causing clamp plates 74 to be advanced toward the log from opposite sides to clamp the log into position. When the log is clamped carriage 15 is advanced toward saw blades 14. After the carriage has been fully advanced, to assure that the log 20 has been sawed into a number of sections, the carriage is automatically returned. As soon as the carriage is returned, clamp plates 74 are retracted to release the log. When this occurs, pusher ram 95 is advanced to push the cut log sections through funnel member 22 and onto cradle members 23*a*–23*f*. After the pusher ram has reached the end of its stroke so that the log sections are properly positioned on the cradle members, the pusher rod is retracted. After a predetermined time delay, cradles 23*a*–23*f* are tilted to cause logs to be moved to splitter units 24*a*–24*f*. As soon as the cradles have been fully tilted to dump the log sections into the adjacent chutes or splitters they are returned to their original position. After a predetermined delay, the first pair of splitters are actuated to split the logs into firewood pieces. After the rams of the first pair of splitters have been fully advanced to split the firewood, they are retracted and the rams of the second pair of splitters are advanced to split the log sections disposed in those splitters. After the rams of the second pair of splitters have been advanced to complete the splitting operation they are retracted. Immediately following this, the rams of the third pair of splitters are advanced to split the logs disposed in those splitters and after the splitting action is completed these rams are retracted.

As indicated in the schematic sequence diagram FIG. 14 a second log is loaded onto the carriage as soon as the first log has been sawed and pushed onto the cradles, and the pusher rod returned. The processor converts a single eight foot log to thirty-six firewood pieces of sixteen inches in length is seventy seconds. However, after the first log has been processed another log is completed processed, every thirty-one seconds. This is due to the fact that two logs are undergoing different processing steps in the unit at the same time.

From the above disclosure of the general principles of the present invention and the preceding description of a preferred embodiment, those skilled in the art will readily comprehend various modifications to which the invention is susceptible.

Having described our invention, we claim:

1. A log processor comprising:

a member for receiving a log;

saw means for simultaneously sawing said log into shorter sections along spaced parallel cuts;

a plurality of cradles disposed along an axis, each cradle being adapted to support one of said sections of log;

ram means for advancing said sections of log along said axis onto said plurality of cradles;

means for tilting said cradles transversely of said axis to dump said logs in a transverse direction;

a plurality of hydraulic log splitters spaced transversely of said axis and adapted to receive logs dumped by said cradles and to split said log sections into segments.

2. The log processor of claim 1 in which said member comprises a carriage, and said saw means comprises a plurality of saw blades rotatable about a fixed axis, and means for moving said carriage transversely of said axis toward and away from said saw blades.

3. The log processor of claim 1 in which said plurality of hydraulic log splitters comprises a first group and a second group, said first group of splitters being disposed on one side of said axis and the second group of splitters being disposed in the opposite side of said axis.

4. The log processor of claim 3 in which the splitters of said first and second group are spaced from one another along the direction of said axis and are spaced at different distances transversely of said axis.

5. The log processor of claim 2 in which said plurality of hydraulic log splitters comprises a first group and a second group, said first group of splitters being disposed on one side of said axis and the second group of splitters being disposed in the opposite side of said axis.

6. The log processor of claim 2 in which the splitters of said first and second group are spaced from one another along the direction of said axis and are spaced at different distances transversely of said axis.

7. The log processor of claim 1 in which said saw means is operative to saw a log while a second previously sawed log is being split by said splitters.

8. The log processor of claim 1 in which said member includes a guide trough for guiding a log along said axis.

9. The log processor of claim 2 in which said carriage includes a guide trough for guiding a log along said axis.

10. A log processor comprising:

a carriage for receiving a log;

clamping means for securing the log to the carriage;

a plurality of spaced parallel saws;

means advancing the carriage toward and away from said saws, said saws cutting said log into a plurality of shorter sections along spaced parallel cuts;

a hydraulic cylinder and ram mounted adjacent to one end of said carriage, said ram being advancable along an axis and being disposed to engage said cut log sections and push said log sections along an axis;

a plurality of cradles disposed along said axis adjacent to the edge of said carriage remote from said hydraulic cylinder, each of said cradles being dimensioned to support one of said log sections;

means of tilting said cradles to dump said log sections in a transverse direction; and a plurality of hydraulic log splitters disposed transversely of said axis and adapted to receive logs dumped by said cradles and to split said log into segments.

11. The log processor of claim 10 in which each of said saws comprises a blade, said blades being rotatable about a fixed axis.

12. The log processor of claim 11 in which said blades are disposed perpendicular to said axis and saw carriage is advanced perpendicular to said axis.

13. The log processor of claim 10 in which said plurality of hydraulic log splitters comprises a first group and a second group, said first group of splitters being disposed on one side of said axis and the second group of splitters being disposed in the opposite side of said axis.

14. The log processor of claim 13 in which the splitters of said first and second group are spaced from one another along the direction of said axis and are spaced at different distances transversely of said axis.

15. The log processor of claim 11 in which said plurality of hydraulic log splitters comprises a first group and a second group, said first group of splitters being disposed on one side of said axis and the second group of splitters being disposed in the opposite side of said axis.

16. The log processor of claim 15 in which the splitters of said first and second group are spaced from one another along the direction of said axis and are spaced at different distances transversely of said axis.

17. The log processor of claim 10 in which said clamps mean comprises hydraulic cylinders and rams, said rams engaging opposite sides of said log.

18. The log processor of claim 10 in which said member includes a guide trough for guiding a log along said axis.

19. The log processor of claim 10 in which said saw means is operative to saw a log while a second previously saved log is being split by said splitters.

* * * * *